US011490715B2

(12) United States Patent
Jacobs

(10) Patent No.: US 11,490,715 B2
(45) Date of Patent: Nov. 8, 2022

(54) FLEXIBLE AND WEARABLE GARMENT BAG FOR LIGHTWEIGHT AND COMFORTABLE TRAVEL

(71) Applicant: ERKAT, LLC, Corinth, TX (US)

(72) Inventor: Valerie Jacobs, Corinth, TX (US)

(73) Assignee: ERKAT, LLC, Corinth, TX (US)

( * ) Notice: Subject to any disclaimer, the term of this patent is extended or adjusted under 35 U.S.C. 154(b) by 0 days.

(21) Appl. No.: 17/030,218

(22) Filed: Sep. 23, 2020

(65) Prior Publication Data

US 2022/0087404 A1 Mar. 24, 2022

(51) Int. Cl.
*A45F 4/02* (2006.01)

(52) U.S. Cl.
CPC ..... *A45F 4/02* (2013.01)

(58) Field of Classification Search
CPC ... A45F 4/02; A45F 3/005; A45F 3/02; A41D 15/04; A41D 2400/422; A41D 2400/424
See application file for complete search history.

(56) References Cited

U.S. PATENT DOCUMENTS 2,058,474 A * 10/1936 Long ..... A41D 15/04 2/85
2,792,576 A * 5/1957 Coady ..... A45F 4/02 5/640
4,643,302 A * 2/1987 Baumgardner ..... A45C 3/00 190/105
5,318,084 A * 6/1994 Jackson ..... A45C 13/30 150/102
5,452,476 A * 9/1995 Jenks ..... A41D 3/00 2/108
5,564,125 A * 10/1996 Waldman ..... A41D 3/00 2/93
5,692,660 A * 12/1997 Stewart ..... A45C 3/00 190/103
6,126,054 A * 10/2000 Riemer ..... A45C 13/1046 224/601
6,370,692 B1 * 4/2002 Duyn ..... A41D 3/02 2/86
6,405,377 B1 * 6/2002 Davis ..... A41D 15/04 2/108
6,817,031 B1 * 11/2004 Gravlin ..... A41D 1/00 2/67
7,185,378 B2 3/2007 Smith
10,021,949 B2 7/2018 Cooper
10,051,945 B1 * 8/2018 Pomare ..... A45F 3/02
10,477,905 B1 * 11/2019 Sachs ..... A41D 3/005
(Continued)

*Primary Examiner* — Brian D Nash
(74) *Attorney, Agent, or Firm* — Hulsey P.C.

(57) ABSTRACT

A flexible garment bag for use during travel is disclosed. The bag includes an elongated and flexible tubular body. The elongated and flexible tubular body includes a storage area. The bag further includes dual closure devices. The dual closure devices mount at each end of the elongated and flexible tubular body. The dual closure devices includes a buckle mechanism. The bag further includes a detachable strap. The storage area stores one or more items such as clothing articles. The detachable strap removably mounts to the buckle mechanism for configuring the bag suitable for wearing over cross body, around waist and over the shoulder. The bag folds upon removing one or more items. Bag includes secondary bag connected to elongated and flexible tubular body for storing smaller items.

14 Claims, 9 Drawing Sheets

(56) References Cited

U.S. PATENT DOCUMENTS

| | | | | |
|---|---|---|---|---|
| 10,758,031 | B2 * | 9/2020 | Sugawara | A45C 13/26 |
| 2011/0017793 | A1 * | 1/2011 | Mellion | A45F 3/02 224/610 |
| 2015/0150319 | A1 * | 6/2015 | Walmsley | A41D 15/04 2/69.5 |
| 2015/0196077 | A1 * | 7/2015 | McIntire, Jr. | A41D 13/0518 2/2.5 |
| 2016/0045008 | A1 * | 2/2016 | Cooper | A45F 4/02 224/577 |
| 2018/0279745 | A1 * | 10/2018 | King | A45F 3/02 |
| 2019/0231100 | A1 | 8/2019 | Pietracatella | |
| 2020/0000156 | A1 * | 1/2020 | Neuhaus | A41D 1/02 |
| 2020/0093245 | A1 * | 3/2020 | Romano | A41D 27/20 |

* cited by examiner

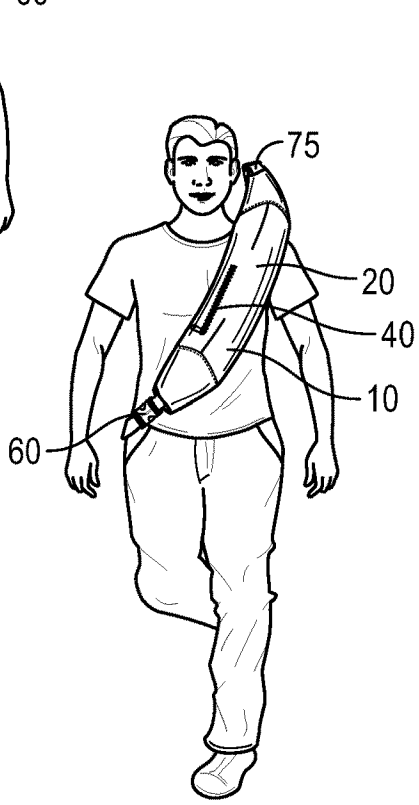
FIG. 14A
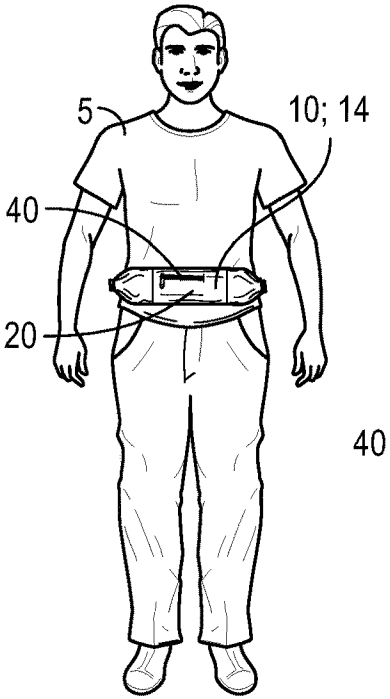
FIG. 14B
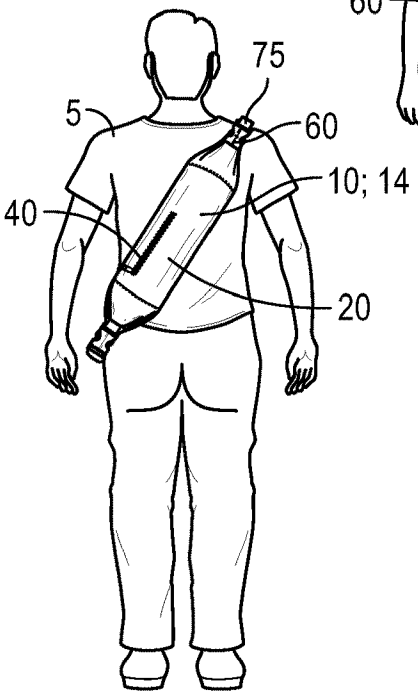
FIG. 14C
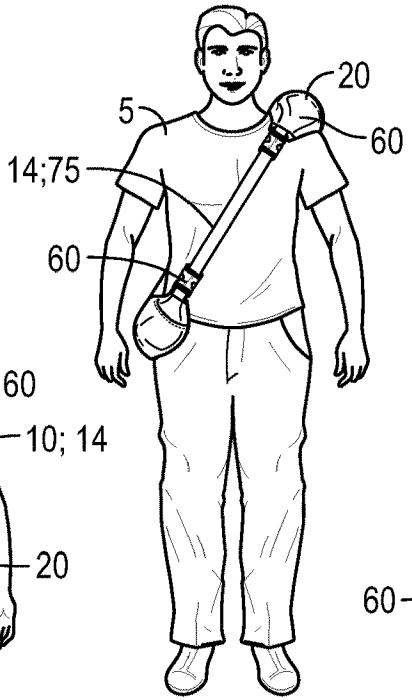
FIG. 14D
FIG. 14E

FLEXIBLE AND WEARABLE GARMENT BAG FOR LIGHTWEIGHT AND COMFORTABLE TRAVEL

FIELD OF THE DISCLOSURE

The present invention generally relates to bags. More specifically, the present invention relates to flexible garment bag for use during travel. Bag includes elongated and flexible tubular body configured for storing one or more items such as clothing articles. Bag includes dual closure devices such as a buckle mechanism and closures tabs for configuring the bag for use as a neck pillow. Bag further includes a detachable strap that mounts to the buckle mechanism for configuring the bag suitable for wearing over cross body, around waist and over the shoulder.

BACKGROUND OF THE DISCLOSURE

Several devices exist for the support and assistance of traveling for users. The devices may include, but not limited to, tote bags, backpacks, purses, laptop bags, fanny packs, neck pillows, etc. However, the devices are limited in their scope and design as they lack modularity or features to serve as other devices aiding in support of travelers. Further, the devices are limited by their design. In addition, functionality of the devices is also limited to single purpose. In addition, the devices are usually considered as carry-on luggage and limited by most airlines.

Several attempts have been made in the past to provide a travel device that attempts to fill a void left by typical travel bags. One such travel device is disclosed in a U.S. Pat. No. 10,021,949, entitled "Collapsible Travel Neck Support Tube" ("the '949 Patent"). The '949 Patent discloses an elongated, flexible tubular container providing neck support for users during travel. The interior of the container is accessible through one or more openings at one or both ends of the container. The openings may be secured with angled zipper closures. The container may be filled with clothing items during packing, and during travel. As a result, the container may bend or may take a horseshoe shape or C-shape around the users neck or other body parts. The ends of the container may be secured to each other to hold the container in place. The container may collapse upon removing the clothing items.

However, the '949 Patent too has limitations due to the restricted nature of the container. For instance, user may have to remove some clothing items present at corners/ends to access clothing articles present at the centre. Additionally, when user tries to remove clothing items from the container in a confined place such as an airplane seat, the container disclosed in the '949 Patent may prevent the user from removing the clothing items. This may cause inconvenience to others within the proximity of user.

In addition, the '949 Patent discloses that longitudinal zippers may be prone to failure due to a lack of stretch surrounding the zipper point. This problem may occur due to the thick garment used in the '949 Patent. The thick garment may prevent the container from stretching when loaded with the clothing items.

Yet another example is disclosed in a United States patent application No. 2019/0231100, entitled "Neck Pillow with Storage Capability" ("the '100 Publication"). The '100 Publication discloses a neck pillow with storage capability. In embodiments, the neck pillow can open to reveal internal compartments, suitable for storage of small personal items. In this way, the neck pillow can also serve as a carrying mechanism as well as functioning as a traditional neck pillow. In this way, one can carry the neck pillow and personal items conveniently. This makes neck pillows of disclosed embodiments convenient for a variety of activities such as relaxing at the beach, concerts, movies, sporting events, and anywhere else where sitting for prolonged periods may occur. Further, the neck pillow may have a pocket to receive a heating and/or cooling pack to be used in conjunction with an individual who has suffered a head or neck injury. Here, the neck pillow may be utilized to promote proper body alignment and provide therapeutic relief.

Yet another example is disclosed in a U.S. Pat. No. 7,185,378, entitled "Adjustable pad/pliable flexible support" ("the '378 Patent"). The '378 Patent discloses an adjustable support/pad that retains any shape to which it is configured and which may be reshaped to serve another purpose. The support/pad has at least one pliable coil spring in the shape of a flexible tube capable of being bent into multiple positions and holding any of the positions until it is again bent. The coil spring is embedded in a deformable cushion to provide comfort of the body wherever the support/pad is applied. The adjustable support can be made into a neck supporting pillow, or a cushion adapted to be removably attached to the back of a chair, to support the back of a seated user.

Although the above-discussed disclosures help to store one or more items such as garments and wearable around one's neck or waist, they have few problems. For instance, neck pillows are bulky and take up too much space. Further, passenger has to carry neck pillow with one hand while also managing his carry-on baggage. This creates unpleasant experience for the passenger/user.

Therefore, there is a need for a flexible garment bag made of a synthetic stretchable fabric for use during travel. The bag that may be configured to store one or more items and suitable to absorb the increased strain at the zipper point to add relief and limit the likelihood of failure. The bag that may be configured to use as neck pillow and may be worn in several different ways.

BRIEF SUMMARY OF THE DISCLOSURE

It is an object of the present invention to provide a flexible garment bag for use during travel and that avoids the drawback of known travel devices.

It is another object of the present invention to provide a flexible garment bag or storage device for use during travel which may be configured to store one or more items and may be worn in several different ways.

It is another object of the present invention to provide a flexible garment bag for carrying personal items in addition to allowable carry-on baggage without having to pay additional fee to air carriers or airlines.

It is another object of the present invention to provide a flexible garment bag that may be configured to wear around user's neck as a neck pillow or their waist for front and back lumbar support when seated during travel.

It is yet another object of the present invention to provide a flexible garment bag that may be worn cross body (in front), cross body (on back), around waist (in front), around waist (in back/lumbar lower back area), and over the shoulder.

In order to achieve to overcome the limitations here stated, the present invention provides a flexible garment bag for use during travel. Bag includes elongated and flexible tubular body including storage area. Elongated and flexible tubular body includes opening provided longitudinally along elongated and flexible tubular for accessing storage area. In one example, elongated and flexible tubular body includes closure mechanism such as zipper provided along the opening. Zipper allows or restricts access to storage area. Storage area stores one or more items such as clothing articles or personal items of a user.

Further, the bag includes pocket or internal storage bag. The pocket may be made accessible from the outside of bag through a zipper. The pocket stores personal items such as mobile phones, passport and so on within the larger bag. Pocket may be provided with the closure mechanism such as zipper for restricting or allowing access to interior of pocket.

In one implementation, elongated and flexible tubular body includes tapered ends. Elongated and flexible tubular body includes tapered pockets at tapered ends. Each tapered end consists of dual closure devices to include a buckle mechanism. Each tapered pocket includes an opening. Further, tapered pockets included in the current embodiment contain the stretchable snap tab closure devices that hide within the opening at the tapered pockets. Storage area of the bag may be stuffed with one or more items such as clothing articles. Further, one of dual closure devices i.e., either the buckle mechanism or closing device, may connect for configuring the bag to use as a neck pillow.

In one implementation, bag may include a detachable strap. Detachable strap mounts to buckle mechanism for transforming the bag such that user may wear the bag in several different ways. For example, user may wear the bag cross body (in front), cross body (on back), around waist (in front), around waist (in back/lumbar lower back area), and over the shoulder.

In another implementation, bag may include secondary bag. Secondary bag may have length slightly larger than the width of bag. User may remove one or items from bag and fold the bag. Subsequently, user may place the bag inside the secondary bag.

In one advantageous feature of the present invention, user may add or remove clothing articles in storage area to adjust the softness or firmness of the bag when used as a neck pillow. Further, user may connect the detachable strap to buckle mechanism and carry or wear the bag without using his hands i.e., hands-free. As a result, user may use his/her hands to carry carry-on baggage. Further, user may place one or more items in bag and get into aircraft without having to pay additional fee for carrying additional items in the bag. Upon reaching his/her seat, user may remove the detachable strap and connect one of dual closure devices for using the bag as a neck pillow. User may remove the clothing articles from bag, and fold the bag to store the bag in secondary bag. User may then carry the secondary bag in carry-on baggage or may carry in his hands or store in an overhead bin or other compartments during travel.

Features and advantages of the subject matter hereof will become more apparent in light of the following detailed description of selected embodiments, as illustrated in the accompanying FIGS. As will be realized, the subject matter disclosed is capable of modifications in various respects, all without departing from the scope of the subject matter. Accordingly, the drawings and the description are to be regarded as illustrative in nature.

BRIEF DESCRIPTION OF THE DRAWINGS

The present subject matter will now be described in detail with reference to the drawings, which are provided as illustrative examples of the subject matter so as to enable those skilled in the art to practice the subject matter. It will be noted that throughout the appended drawings, like features are identified by like reference numerals. Notably, the FIGS. and examples are not meant to limit the scope of the present subject matter to a single embodiment, but other embodiments are possible by way of interchange of some or all of the described or illustrated elements and, further, wherein:

FIGS. 14A through 14E illustrate user wearing bag in several different ways, in accordance with various exemplary embodiments of present invention;

DETAILED DESCRIPTION OF THE EMBODIMENTS

Figure 1A:
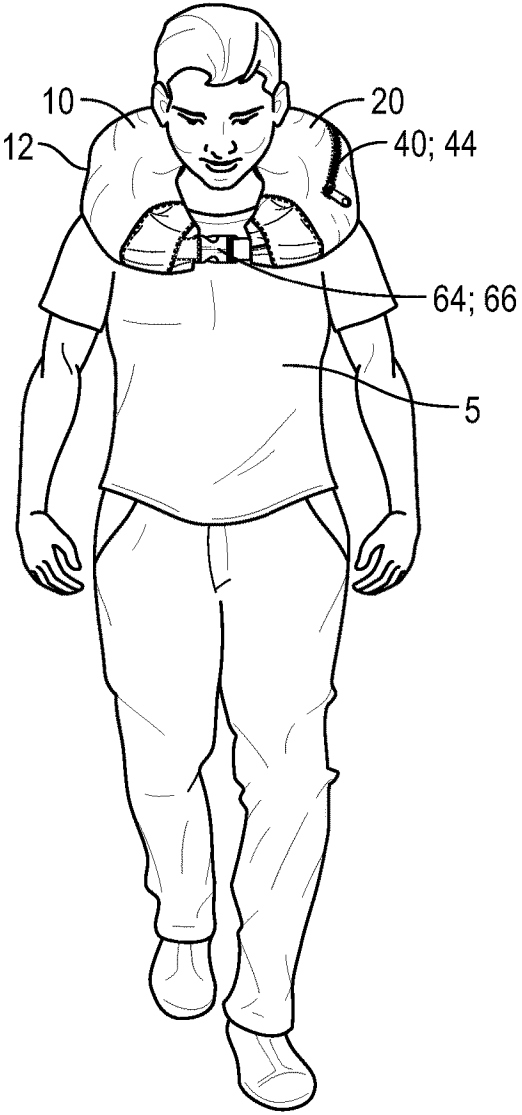
FIGS. 1A, and 1B and 1C illustrate user wearing flexible garment bag or storage device in first configuration and second configuration, respectively, in accordance with one embodiment of present invention.

The detailed description set forth below in connection with the appended drawings is intended as a description of exemplary embodiments in which the presently disclosed subject matter may be practiced. The term "exemplary" used throughout this description means "serving as an example, instance, or illustration," and should not necessarily be construed as preferred or advantageous over other embodiments. The detailed description includes specific details for providing a thorough understanding of the presently disclosed bag. However, it will be apparent to those skilled in the art that the presently disclosed subject matter may be practiced without these specific details. In some instances, well-known structures and devices are shown in functional or conceptual diagram form in order to avoid obscuring the concepts of the presently disclosed bag.

In the present specification, an embodiment showing a singular component should not be considered limiting. Rather, the subject matter preferably encompasses other embodiments including a plurality of the same component, and vice-versa, unless explicitly stated otherwise herein. Moreover, the applicant does not intend for any term in the specification or claims to be ascribed an uncommon or special meaning unless explicitly set forth as such. Further, the present subject matter encompasses present and future known equivalents to the known components referred to herein by way of illustration.

Although the present disclosure provides a description of bag for use during travel, it is to be further understood that numerous changes may arise in the details of the embodiments of the flexible garment bag. It is contemplated that all such changes and additional embodiments are within the spirit and true scope of this disclosure.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure.

It should be understood that the present invention describes a flexible garment for use during travel. The bag includes an elongated and flexible tubular body. The elongated and flexible tubular body includes a storage area. The bag further includes dual closure devices. The dual closure devices mount at each end of the elongated and flexible tubular body. The said dual closure devices includes a buckle mechanism. The bag further includes a detachable strap. The storage area stores one or more items such as clothing articles. The buckle mechanism connects the ends of elongated and flexible tubular body for using the bag as a neck pillow. The detachable strap mounts to the buckle mechanism for configuring the bag suitable for wearing over cross body, around waist and over the shoulder. The bag folds upon removing one or more items. The bag includes a secondary bag for storing the folded bag. Secondary bag stores smaller items. Elongated and flexible tubular body, pocket and secondary bag are provided with closer mechanisms for restricting or allowing access to their interior or storage area.

Various features and embodiments of a flexible garment bag for use during travel are explained in conjunction with the description of FIGS. 1-17.

Figure 1B:
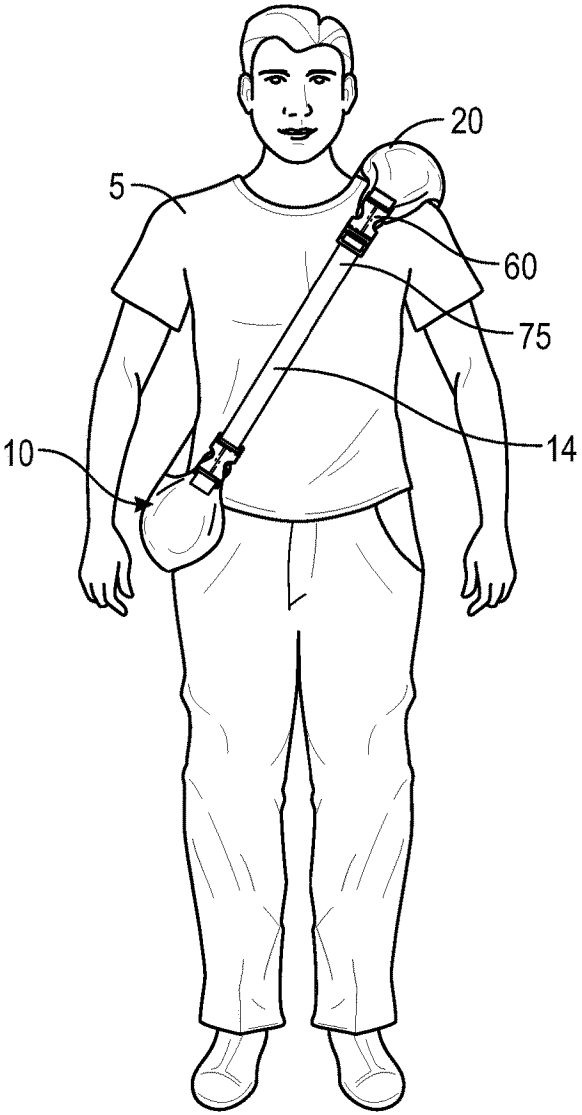
Figure 1C:
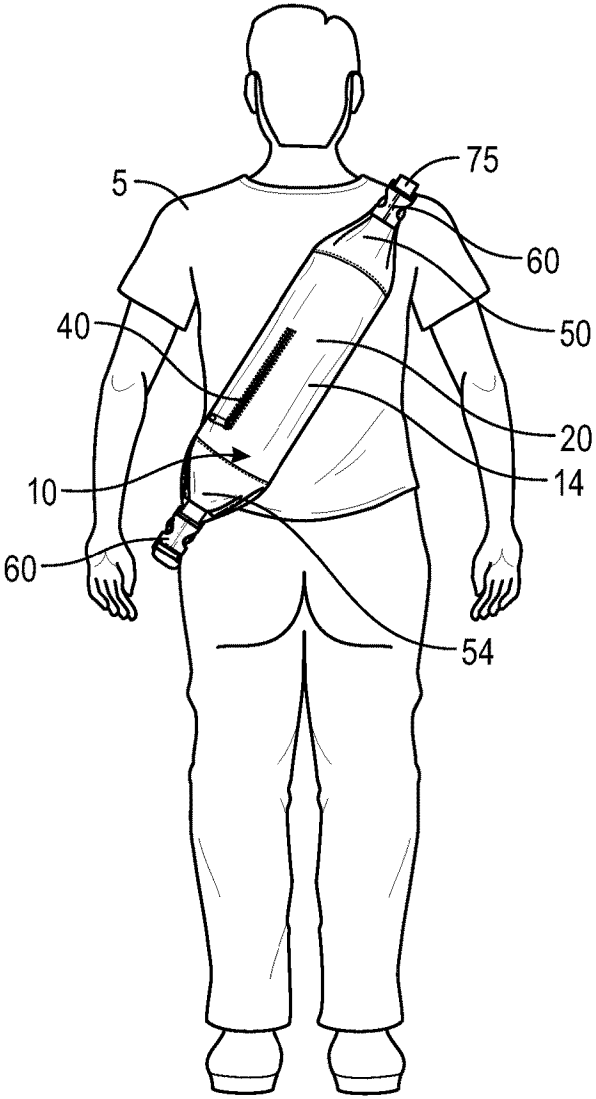
Figure 2:
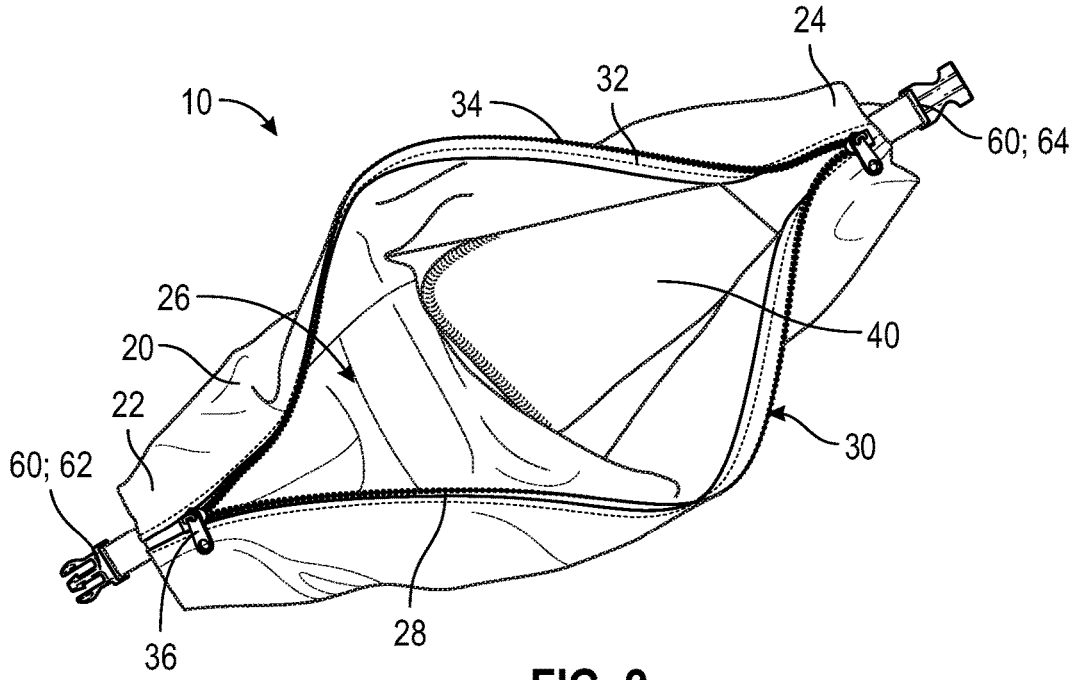
FIGS. 2 and 3 illustrate a top perspective view and a side view of a bag, respectively, in accordance with one embodiment of present invention.
Figure 3:
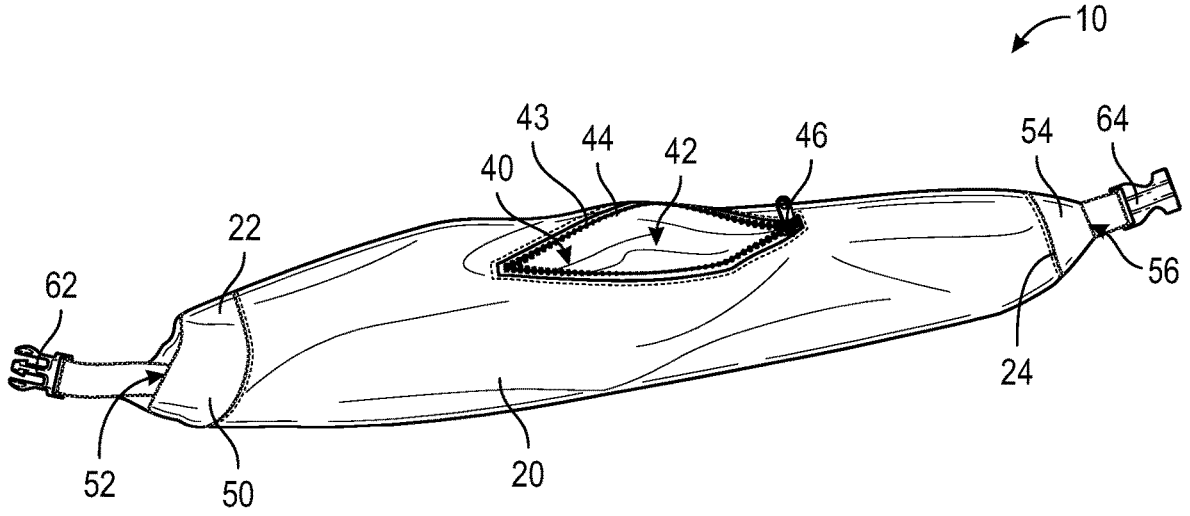

In one embodiment, the present invention discloses a flexible garment bag 10 for use during travel. FIGS. 1A, and 1B and 1C show user 5 wearing flexible garment bag or storage device 10 in first configuration 12 and second configuration 14, respectively, in accordance with one or more embodiments of the present invention. FIGS. 2 and 3 show constructional features of bag 10. Bag 10 may include elongated and flexible tubular body or tubular member 20 made of fabric, leather, synthetic, natural materials such as cotton and blends, woven or knitted fabric or any other suitable material. Elongated and flexible tubular body 20 may include fabric having desired properties such as light weight, elasticity, water and UV resistance and comfort against user's skin and so on. In one implementation, elongated and flexible tubular body 20 may be constructed using a soft and pliable fabric or neoprene or stretchable fabric or flexible and wearable garment. Elongated and flexible tubular body 20 may include first end 22 and second end 24. Each of first end 22 and second end 24 may include tapered or rounded or squared shape. First end 22 and second end 24 may be tapered to conform to the user's neck area when bag 10 may be used as a neck pillow. Further, elongated and flexible tubular body 20 may include storage area or article/item receptacle area or inner cavity 26. Further, elongated and flexible tubular body 12 may include opening 28 for providing access to storage area 26.

FIG. 1A shows opening 28 provided along the length of elongated and flexible tubular body 20. At opening 28, elongated and flexible tubular body 20 may include a closure mechanism such as zipper 30. Zipper 30 allows or restricts access to storage area 26. Zipper 30 may extend along the entire length of elongated and flexible tubular body 20. In one implementation, a single full length zipper 30 extends along the entire length of elongated and flexible tubular body 20. In another implementation, zipper 30 includes dual or two half length zippers, each zipper 30 extending half the length of elongated and flexible tubular body 20. Here, both half length zippers extend and cover the entire length of elongated and flexible tubular body 20. Each of the half length zippers 30 separately allows or restricts access to said storage area 26. Similarly, a person skilled in the art may provide three or more zippers 30 having same or different length. Here, three or more zippers 30 extend over the entire length of elongated and flexible tubular body 20 to allow or restrict access to said storage area 26.

Zipper 30 may include tape or flexible band or strap 32. Tape 32 may be sewn to opening 28. Tape 32 may include elements or teeth 34. Further, zipper 30 may include sliders or zipper fasteners 36. Zipper fasteners 36 allow or restrict access to storage area 26. It should be understood that zipper 30 as closure mechanism is shown for illustrative purpose only and should not be construed in limited sense. Other closure mechanisms for restricting and allowing access to storage area 26 via opening 28 may also be incorporated in place of zipper 30. For example, closure mechanisms such as hook-and-loop fabric, drawstrings, buttons, snaps, and/or magnetic closures may also be provided in addition to or in lieu of the zipper, and such implementations come within the scope of the present invention.

Bag 10 further includes pocket or internal storage bag 40. Pocket 40 resides inside storage area 26 and allows access from the side of elongated and flexible tubular body 20 as shown in FIG. 3. Pocket 40 may indicate a secondary storage area formed within storage area 26. Zipper 40 allows access to pocket 40 from the side of elongated and flexible tubular body 20. Pocket 40 may include storage area 42 with opening 43. Pocket 40 may further include second closure mechanism such as second zipper 44. Zipper 44 may include slider or zipper fastener 46. Zipper fastener 46 allows or restricts access to storage area 42. Although it is described that pocket 40 includes zipper 44 for restricting or allowing access to interior of pocket 40, other closure mechanisms such as hook-and-loop fabric, drawstrings, buttons, snaps, and/or magnetic closures may also be provided in addition to or in lieu of the zipper mechanism, and such implementations are intended to come within the scope of the present invention.

In one embodiment, pocket 40 stores smaller items such as mobile phones, passport, paper bills, currency notes, travel documents and other items.

Further, bag 10 may include tapered pockets. Specifically, bag 10 may include two tapered pockets i.e., first tapered pocket 50 and second tapered pocket 54, as shown in FIG. 3. first end 22 may include first tapered pocket 50 and second end 24 may include second tapered pocket 54. First tapered pocket 50 may include opening 52. Similarly, second tapered pocket 54 may include opening 56. It should be understood that pockets provided at the tapered ends of elongated and flexible tubular body 20 may be referred as tapered pockets for ease of reference. However, it should not be construed in limited sense.

Figure 4:
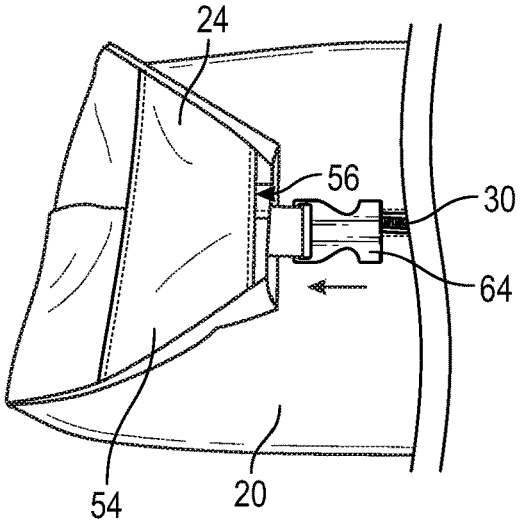
FIGS. 4 through 6 illustrate dual closure devices i.e., buckle mechanism and stretchable snap tabs provided at ends of elongated and flexible tubular body, in accordance with one embodiment of present invention.
Figure 5:
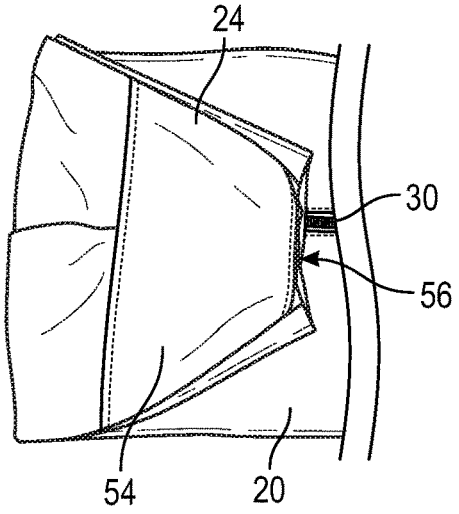
Figure 6:
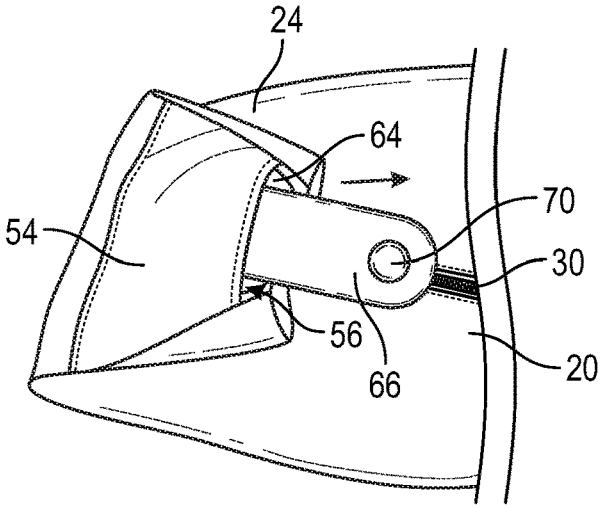
Figure 7:
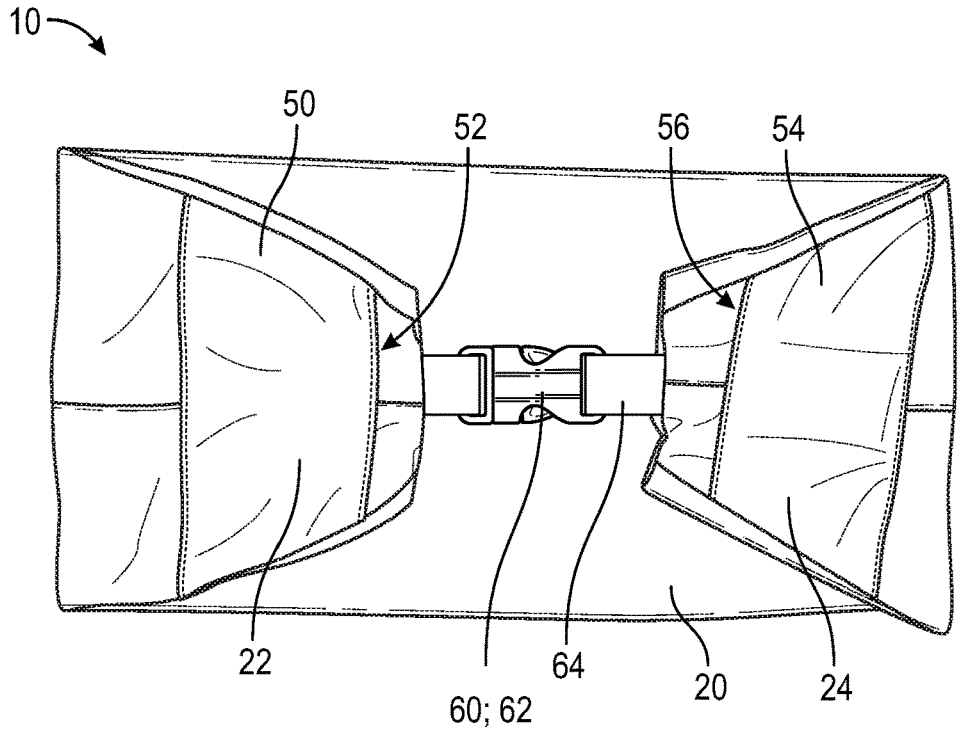
FIGS. 7 and 8 illustrate mounting of buckle mechanism, and stretchable snap tabs, respectively for configuring bag in first configuration, in accordance with one embodiment of present invention.
Figure 8:
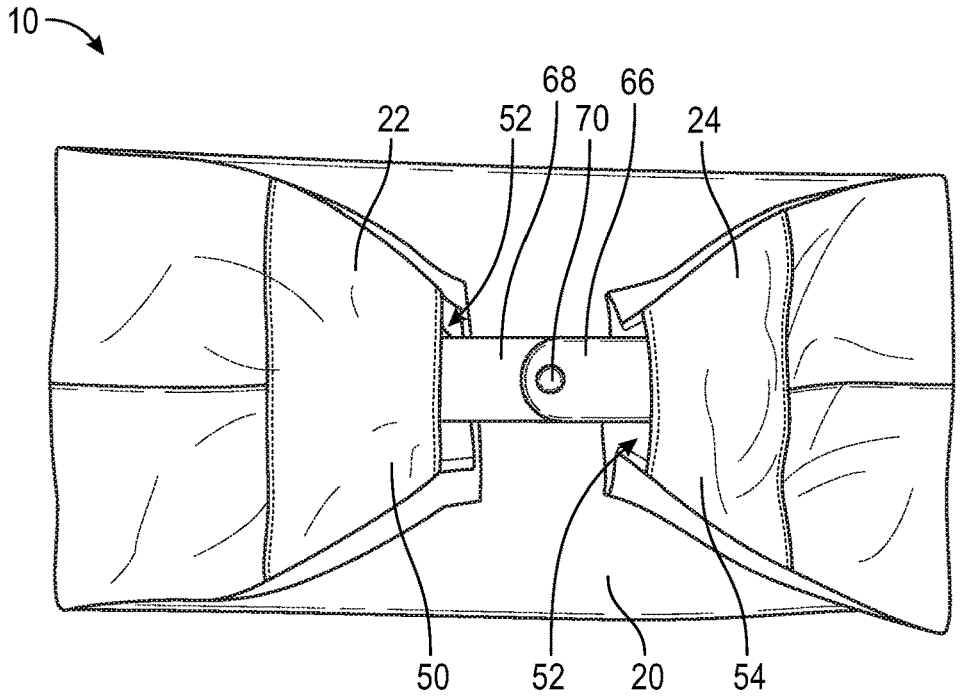

In accordance with one embodiment of the present invention, bag 10 may include dual closure devices or two closure devices for positioning bag 10 in first configuration 12 around user's neck as shown in FIG. 1A. Dual closure devices may include a first closure device/mechanism and a second closure device/mechanism. In one example, first closure device/mechanism may include buckle mechanism 60 as shown in FIGS. 2 and 3. Buckle mechanism 60 may include male buckle member 62 and female buckle member 64. In the current embodiment, first end 22 may include male buckle member 62. Male buckle member 62 may withdraw or fold into first closure device 50. Similarly, second end 24 may include female buckle member 64. Female buckle member 64 may withdraw or fold into second tapered pocket 54. FIGS. 4 and 5 show the feature of female buckle member 64 withdrawn or folded into second tapered pocket 54, in accordance with one exemplary embodiment of the present invention. FIG. 4 shows a feature of female member 64 provided at second end 24. In the current embodiment, second tapered pocket 54 may receive female buckle member 64 through opening 56, as shown in FIG. 5. Similarly, first tapered pocket 50 may receive male buckle member 62 through opening 52.

Figure 9:
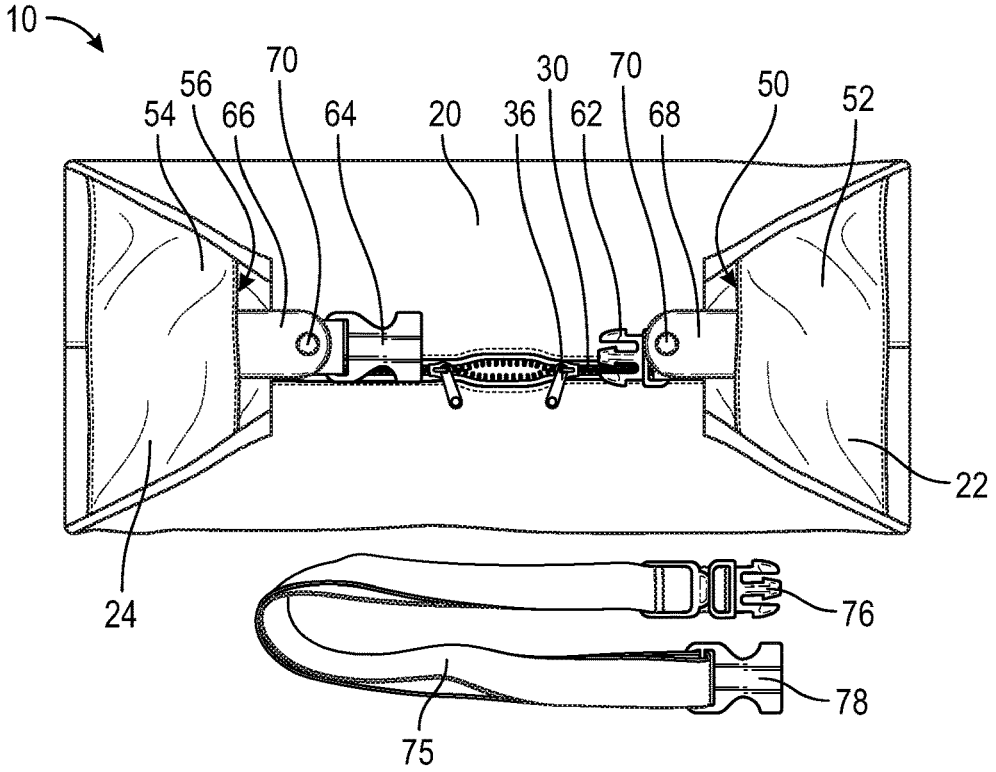
FIG. 9 illustrates bag including detachable strap, in accordance with one embodiment of present invention.
Figure 10A:
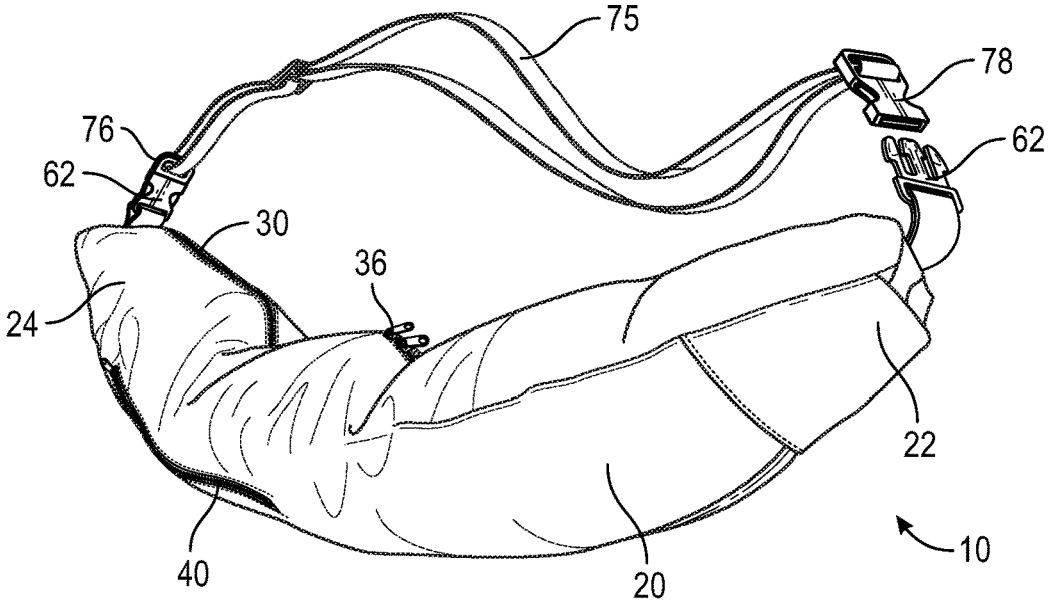
FIGS. 10A through 10C illustrate detachable strap mounted to buckle mechanism for configuring bag in second configuration, in accordance with one embodiment of present invention.
Figure 10B:
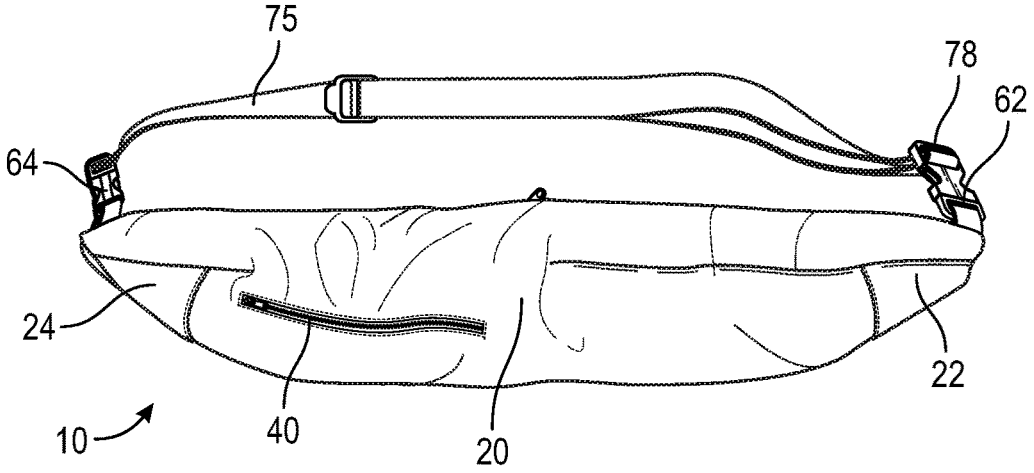
Figure 10C:
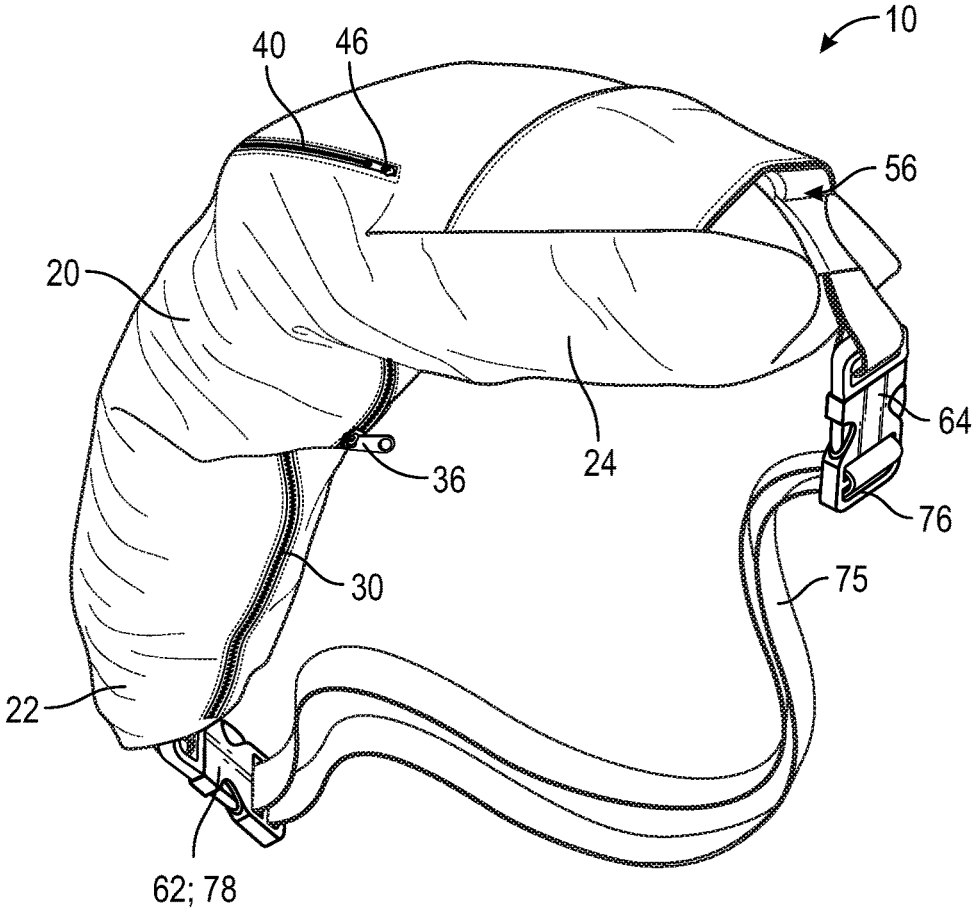

In accordance with one embodiment of the present invention, bag 10 may include detachable strap 75 as shown in FIG. 9. Detachable strap 75 may include webbing and length may be adjustable. Detachable strap 75 may include male member 76 and female member 78 provided at far ends. FIGS. 10A through 10C show detachable strap 75 mounted to buckle mechanism 60, in accordance with one embodiment of the present invention. Specifically, male member 76 may mount to female buckle member 64 and female member 78 may mount to male buckle member 62 to position bag 10 in second configuration 14.

In accordance with one embodiment of the present invention, bag 10 stores one or more items (not shown). For instance, bag 10 stores one or more items such as clothing articles. Clothing articles may include shirts, skirts, bath towels, blankets, or any other items made of soft material. In order to store one or more items in bag 10, user 5 may access storage area 26 and place one or more items in storage area 26. Subsequently, user 5 may close zipper 30.

Figure 11:
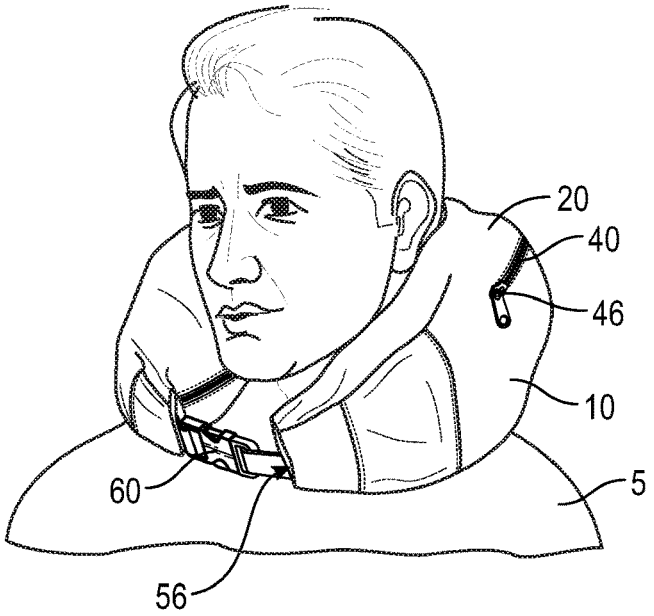
FIGS. 11 through 13 illustrate user wearing bag in first configuration for use as a neck pillow, in accordance with various exemplary embodiments of present invention.
Figure 12:
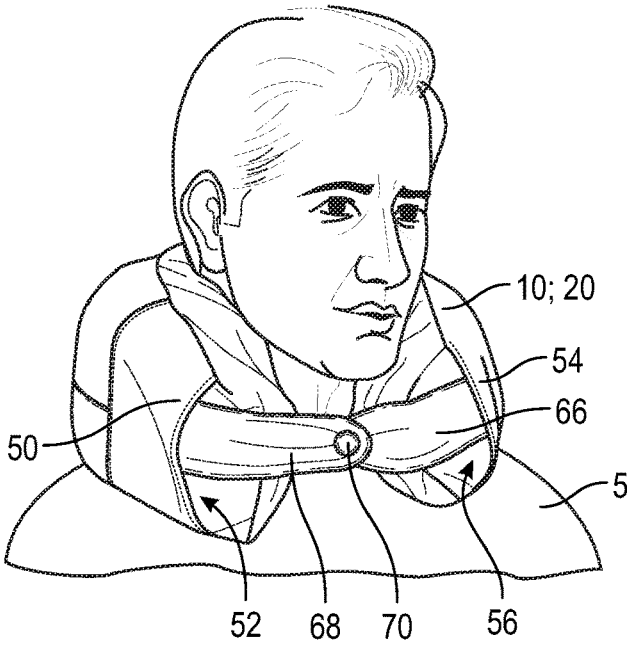

As specified above, one of dual closure devices (i.e., first closure device (buckle mechanism 60) or second closure device (stretchable snap tabs)) may allow to position bag 10 in first configuration 12 to support user's neck or any other body parts. As such, bag 10 stuffed with one or more items may be used as a neck pillow. FIG. 11 shows user 5 using the bag 10 as a neck pillow, in accordance with one exemplary embodiment of the present invention. Here, user 5 may place bag 10 i.e., elongated and flexible tubular body 20 in first configuration 12 around his/her neck. Subsequently, user 5 may fasten buckle mechanism 60 by connecting male buckle member 62 and female buckle member 64. FIG. 12 shows user 5 using bag 10 as a neck pillow, in accordance with another exemplary embodiment of the present invention. Here, user 5 may place bag 10 i.e., elongated and flexible tubular body 20 in first configuration 12 around his neck. It should be understood that user 5 may selectively use one of dual closure devices (i.e., first closure device (buckle mechanism 60) or second closure device to secure bag 10 around the neck for use as a neck pillow.

It should be understood that the user 5 may adjust softness or firmness of the neck pillow (elongated and flexible tubular body 20) by adding or removing one or more items from storage area 26.

In another embodiment, detachable strap 75 allows the user 5 to wear bag 10 in several different ways. For example, detachable strap 75 allows user 5 to wear bag 10 around shoulder, back, waist and cross over the body. FIGS. 14A through 14E show user 5 wearing bag 12 in different ways. FIG. 14A shows user 5 wearing bag 10 in second configuration 14 around his waist, in accordance with one exemplary embodiment of the present invention. In the current embodiment, user 5 may place elongated and flexible tubular body 20 at back and place detachable strap 75 at the torso area of user 5. Subsequently, user 5 may tighten detachable strap 75 to adjust the length of detachable strap 75. Here, elongated and flexible tubular body 20 may act as a back support for user 5 when sitting on a chair or vehicle's seat.

FIG. 14B shows user 5 wearing bag 10 in second configuration 14 around his waist, in accordance with another exemplary embodiment of the present invention. In the current embodiment, user 5 may place elongated and flexible tubular body 20 at the torso area and place detachable strap 75 at the back. Subsequently, user 5 may adjust the length of detachable strap 75. Here, user 5 may place elongated and flexible tubular body 20 over his/her lap with support from detachable strap 75 at the back. In one example, user 5 may position bag 10 as shown in FIG. 14B at the time of sitting on a chair or vehicle's seat. In another example, user 5 may stand or walk wearing bag 10 around his waist as shown in FIG. 14B.

FIGS. 14C and 14D show front and rear view of user 5 wearing bag 10 crossbody over the shoulder, in accordance with another exemplary embodiment of the present invention. Here, user 5 may adjust the length of detachable strap 75 and place elongated and flexible tubular body 20 crossbody over the shoulder. Subsequently, user 5 may connect detachable strap 75 to buckle mechanism 60 provided at ends of elongated and flexible tubular body 20. In one example, user 5 may stand or walk wearing bag 10 crossbody over the shoulder as shown in FIGS. 14C and 14D.

FIG. 14E shows front view of user 5 placing elongated and flexible tubular body 20 adjacent to his neck for support, in accordance with another exemplary embodiment of the present invention. Here, user 5 may adjust the length of detachable strap 75 and place elongated and flexible tubular body 20 next to his neck for providing cushion effect to his/her neck when seated in a plane, boat, bus or any other vehicle.

As specified above, user 5 may adjust softness or firmness of the neck pillow (elongated and flexible tubular body 20) by adding or removing one or more items from storage area 26. Further, elongated and flexible tubular body 20 may be constructed using a soft and pliable fabric or neoprene or stretchable fabric or flexible and wearable garment. As such, bag 10 absorbs increased strain at zipper 30 even after stuffing more clothing articles in storage area 26. Thus, bag 10 limits the likelihood of failure at zipper 30.

Figure 15:
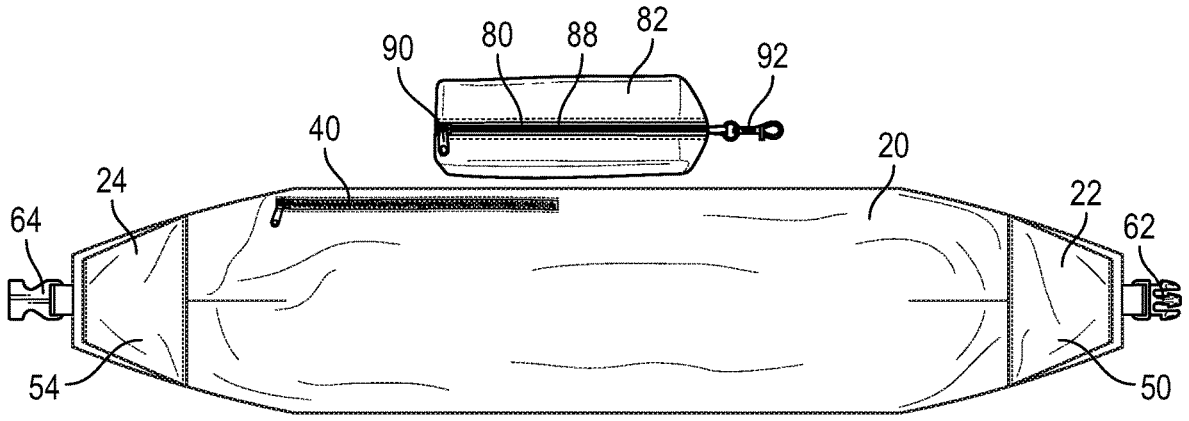
FIG. 15 illustrates bag including secondary bag, in accordance with another embodiment of the invention.
Figure 16:
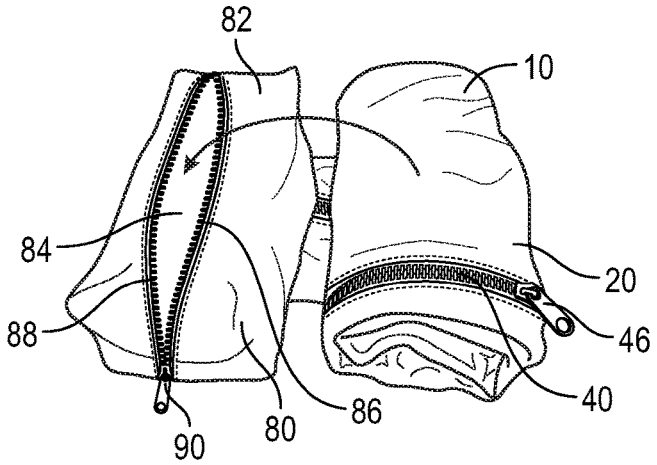
FIGS. 16 and 17 illustrate a feature of folding bag and storing bag in secondary bag, in accordance with another embodiment of the invention.

In one embodiment, bag 10 may include secondary bag 80 as shown in FIGS. 15 and 16. Secondary bag 80 may indicate a smaller flexible garment bag or container for storing the larger bag 10 in folded position. Alternatively, secondary bag 80 may store one or items having smaller dimensions. Secondary bag 80 may include elongated and flexible tubular body or tubular member 82. Elongated and flexible tubular body 82 may be made of fabric, leather, synthetic, natural materials such as cotton and blends, woven or knitted fabric or any other suitable material. In the current embodiment, length of secondary bag 80 i.e., elongated and flexible tubular body 82 may be slightly larger than the width of elongated and flexible tubular body 20 of bag 10 (FIG. 16). Elongated and flexible tubular body 82 may include storage area 84. Storage area 84 may include opening 86. At opening 86, elongated and flexible tubular body 82 may include zipper 88 with zipper fastener 90. Further, secondary bag 80 may include bag connector 92 at one end of elongated and flexible tubular body 82. Bag connector 92 may include, but not limited to, D-ring, O-ring, clasp, clip, hook, karabiner, hook and loop fastener or any other similar mechanism for connecting secondary bag 80 to bag 10.

Figure 17:
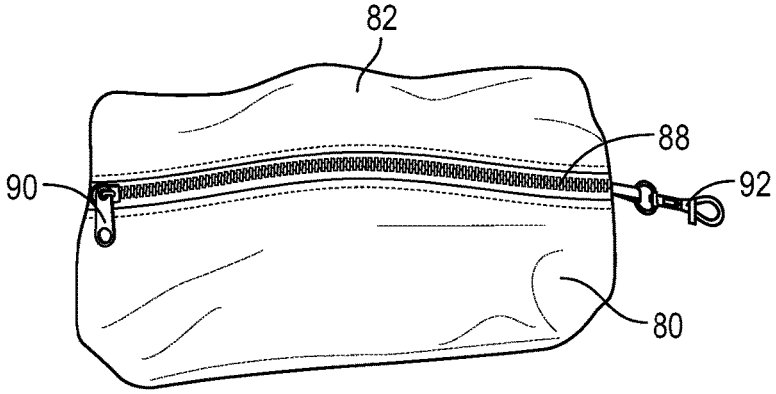

As specified above, length of secondary bag 80 i.e., elongated and flexible tubular body 82 may be slightly larger than the width of elongated and flexible tubular body 20 of bag 10 (FIG. 16). User 5 may remove one or more items stored in storage area 26 and fold bag 10. Subsequently, user 5 may place bag 10 in storage area 84, as shown in FIG. 16. After placing the bag 10 in secondary bag 80, user 5 may operate zipper fastener 90 to close zipper 88, as shown in FIG. 17. Alternatively, user 5 may place secondary bag 80 inside or connected to any other luggage he/she may be carrying during the travel.

As bag 10 allows to configure for carrying on the shoulder of the user or slung over the back, front around the waist, crossbody; user may carry additional baggage/luggage during travel with his/her hands. Bag 10 allows for storage underneath the seat of an aircraft due to compact size of bag 10. Thus, airlines/airline staff may allow user 5 to carry bag 100 without paying additional charges.

Figure 13:
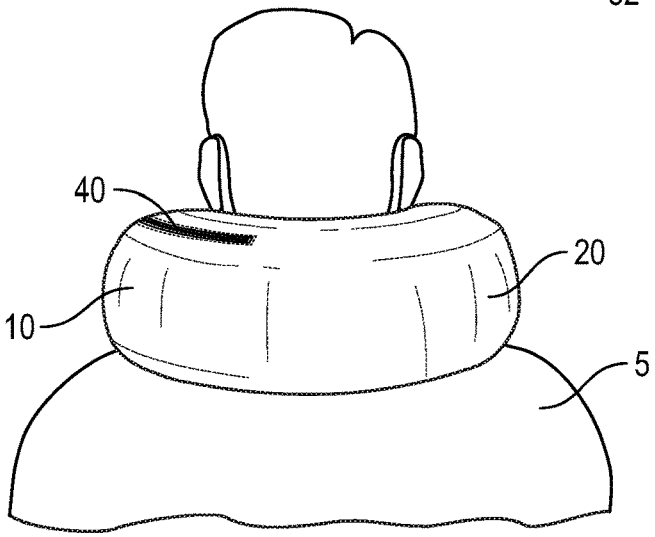

User 5 may place additional items or frequently used items during travel in bag 10 and strap onto the body (as shown in FIGS. 14A through 14E). User 5 may carry bag 10 in addition to carry-on luggage and head to aircraft. After reaching the designated or assigned seat in the aircraft, user 5 may demount or detach detachable strap 75. Subsequently, user 5 may mount one of first closure device (buckle mechanism 60) or second closure device to secure bag 10 around the neck for use as a neck pillow, as shown in FIGS. 11 through 13. Alternatively, user 5 may adjust the length of strap 75 to use elongated and flexible tubular body 20 as support for resting his neck as shown in FIG. 14E.

User 5 may remove one or more items stored in storage area 26. Subsequently, user 5 may fold bag 10 and place bag 10 in secondary bag 80. Further, user 5 may place secondary bag 80 in carry-on baggage or place in an overhead bin or other compartments or may carry secondary bag 80 in his/her hand during travel.

In one embodiment, user 5 may connect one end of detachable strap 75 i.e., male member 76 or female member 78 to buckle mechanism 60 and connect other end to secure to other luggage. This allows bag 10 to connect with other luggage that user 5 may be carrying during travel.

In one example, elongated and flexible tubular body 20 may have dimensions 30"(length)×8"(width) when empty. Elongated and flexible tubular body 82 of secondary bag 80 may have dimensions 7"(length)×4"(width) when empty. It should be understood that the above dimensions are provided for illustrative purpose only, a person skilled in the art will understand that size of bag 10 and secondary bag 80 may change depending whether bag 10 needs to be designed for adults or children, or depending on age or gender of users.

The above description incorporates features considering that bag may be filled or stuffed with one or more items such as clothing articles. However, it should be noted that the bag may be stuffed with other material including, but not limited to, foam, batting, buckwheat, or similar materials as desired.

The presently disclosed bag may be constructed using a synthetic stretchable fabric or using a certain type of stretchable fabric. As a result, bag may absorb the increased strain at the zipper provided along the length of elongated and flexible tubular body. This adds relief and limits the likelihood of failure of the zipper.

Based on the above, it is evident that bag may be used for carrying additional items in excess of one carry-on baggage without paying extra to air carriers. Further, the bag filled with one or more items may be used as a neck pillow without the detachable strap; utilizing one of the dual closure mechanisms. Further, the bag filled with one or more items may utilize the detachable strap for lumbar support when seated during travel. Further, the detachable strap allows the user to wear the bag cross body (front or back), around waist (front or back i.e., in lumbar or lumbar back area) and over shoulder. As a result, the presently disclosed bag may be transformed into different configurations and may be worn several different ways. The presently disclosed bag may be used during travel via aircraft, train, bus, car or any other land, air or water based vehicles. The bag may be customized for neck or lumbar support or back support for users in every mode of transportation.

In the above description, numerous specific details are set forth such as examples of some embodiments, specific components, devices, methods, in order to provide a thorough understanding of embodiments of the present disclosure. It will be apparent to a person of ordinary skill in the art that these specific details need not be employed, and should not be construed to limit the scope of the disclosure.

In the development of any actual implementation, numerous implementation-specific decisions must be made to achieve the developer's specific goals, such as compliance with system-related and business-related constraints. Such a development effort might be complex and time consuming, but is nevertheless a routine undertaking of design, fabrication, and manufacture for those of ordinary skill. Hence as various changes could be made in the above constructions without departing from the scope of the invention, it is intended that all matter contained in the above description or shown in the accompanying drawings shall be interpreted as illustrative and not in a limiting sense.

The foregoing description of embodiments is provided to enable any person skilled in the art to make and use the subject matter. Various modifications to these embodiments will be readily apparent to those skilled in the art, and the novel principles and subject matter disclosed herein may be applied to other embodiments without the use of the innovative faculty. The claimed subject matter set forth in the claims may not intended to be limited to the embodiments shown herein, but is to be accorded the widest scope consistent with the principles and novel features disclosed herein.

What is claimed is:

1. A flexible garment bag for use during travel, said bag comprising:

an elongated and flexible tubular body comprising a storage area; and dual closure devices, dual closure devices mount at ends of said elongated and flexible tubular body, said dual closure devices comprising a buckle mechanism and closures, wherein said stretchable snap tabs connect via a tab connector for connecting the end of elongated and flexible tubular body for using the bag as a neck pillow during travel;

wherein said storage area stores one or more items, and wherein one of dual closure devices mounts for connecting the ends of elongated and flexible tubular body for using the bag as a neck pillow during travel.

2. The flexible garment bag of claim 1, wherein said elongated and flexible tubular body comprises a tapered pocket at each end.

3. The flexible garment bag of claim 2, wherein each of said tapered pockets comprises an opening configured for receiving one of dual closure devices.

4. The flexible garment bag of claim 1, further comprises a detachable strap, said detachable strap removably mounts to said buckle mechanism.

5. The flexible garment bag of claim 4, wherein length of said detachable strap adjustable for configuring said bag suitable for wearing over cross body, around waist and over the shoulder.

6. The flexible garment bag of claim 1, wherein said elongated and flexible tubular body comprises a closure mechanism, and wherein said closure mechanism restricts or allows access to said storage area.

7. The flexible garment bag of claim 1, further comprises a secondary bag, wherein said bag folds upon removing one or more items, and wherein said secondary bag stores the folded bag.

8. The flexible garment bag of claim 1, further comprises a pocket formed within said storage area, and wherein said pocket allows access to its interior from outside of said elongated and flexible tubular body.

9. The flexible garment bag of claim 8, wherein said pocket comprises a closure mechanism, wherein said closure mechanism allows or restricts access to interior of said pocket.

10. A flexible garment bag for use during travel, said bag comprising:

an elongated and flexible tubular body comprising a storage area, said elongated and flexible tubular body comprising a closure mechanism, wherein said closure mechanism allows or restricts access to said storage area storing the one or more items, said closure mechanism comprising a single full length or dual half length closure mechanism, wherein said closure mechanism comprises one of a zipper mechanism, velcro, snaps, hook-and-loop fabric, drawstrings, buttons, and magnetic closures;

dual closure devices, dual closure devices mount at ends of said elongated and flexible tubular body, wherein said dual closure devices comprises a buckle mechanism and closures and a detachable strap;

wherein said storage area stores one or more items, and wherein one of buckle mechanism and stretchable snap tabs mounts for connecting the ends of elongated and flexible tubular body for using the bag as a neck pillow, or wherein said detachable strap removably mounts to the buckle mechanism for configuring the bag suitable for wearing over cross body, around waist and over the shoulder.

11. The flexible garment bag of claim 10, wherein said elongated and flexible tubular body comprises a tapered pocket at each end.

12. The flexible garment bag of claim 11, wherein each of said tapered pocket comprises an opening configured for hiding and storing one of buckle mechanism and closures.

13. The flexible garment bag of claim 10, further comprises a secondary bag, wherein said bag folds upon removing the one or items, wherein said secondary bag stores the folded bag.

14. The flexible garment bag of claim 10, further comprises a pocket formed within said storage area, wherein said pocket comprises a closure mechanism, and wherein said closure mechanism allows or restricts access to interior of said pocket.

* * * * *